US005233752A

United States Patent [19]

Lyons

[11] Patent Number: 5,233,752

[45] Date of Patent: Aug. 10, 1993

[54] PORTABLE APPARATUS FOR AIR TURNING ASSEMBLY FABRICATION

[75] Inventor: John E. Lyons, Leviton, N.Y.

[73] Assignee: Duro Dyne Corporation, Farmingdale, N.Y.

[21] Appl. No.: 974,876

[22] Filed: Nov. 12, 1992

Related U.S. Application Data

[60] Continuation-in-part of Ser. No. 875,306, Apr. 29, 1992, Pat. No. 5,181,314, which is a division of Ser. No. 692,990, Apr. 29, 1991.

[51] Int. Cl.[5] ..... B23P 19/00; B23P 11/00

[52] U.S. Cl. ..... 29/796; 29/243.5; 29/283.5

[58] Field of Search ..... 29/791, 796, 243.5, 29/281.1, 283.5, 513

[56] References Cited

U.S. PATENT DOCUMENTS 3,455,008 7/1969 Harper ..... 29/513

*Primary Examiner*—P. W. Echols
*Assistant Examiner*—David P. Bryant
*Attorney, Agent, or Firm*—Mark T. Basseches; Paula T. Basseches

[57] ABSTRACT

A portable apparatus for forming an air turning assembly comprises upper and lower rail retaining tracks which are yieldably biased toward each other. Vane distorting chisels are mounted in spaced relation below the lower track and a staking assembly, movable longitudinally so as to sequentially register with the chisels, is mounted above the upper track. The staking assembly is shiftable toward the fixed chisels beneath the lower track whereby edges of a vane temporarily mounted between the rails may be staked in a single operation to both rails, downward movement of the staking chisels being effected to deform portions of the vane above the upper rail, such downward movement also functioning bodily to shift the rails and vane downwardly, such the portions of the vane below the lower rail are deformed by the chisels below the lower rail.

11 Claims, 7 Drawing Sheets

PORTABLE APPARATUS FOR AIR TURNING ASSEMBLY FABRICATION

This application is a continuation-in-part of application Ser. No. 875,306, filed Apr. 29, 1992, now U.S. Pat. No. 5,181,314, said application in turn being a division of application Ser. No. 07/692,990, filed Apr. 29, 1991.

BACKGROUND OF THE INVENTION

1. Field of the Invention

The present invention is in the field of air turning devices for mounting within ducting of air conditioning systems to facilitate the flow of air around corners in the system so as to minimize turbulence and frictional losses.

More specifically, the present invention is directed to an apparatus for fabricating such assemblies.

2. The Prior Art

It is conventional in air conduits or ducting such as are employed in air conditioning systems to provide air turning assemblies at positions where sections of ducting meet in angular relation Such air turning assemblies generally comprise upper and lower rails, known as vane rails, between which are mounted a series of arcuate vanes. The turning assemblies guide the air from one duct arm to the next, minimizing turbulence.

Examples of such air guide devices and stock materials from which the same may be made are found in U.S. Pat. Nos. 2,861,597 of Nov. 25, 1958; 2,972,358 of Feb. 21, 1961; 2,959,195 of Nov. 8, 1960; 3,190,250 of June 22, 1965; 3,494,379 of Feb. 10, 1970; 3,602,262 of Aug. 31, 1971 and 4,995,426 of Feb. 26, 1991, as well as certain references cited therein.

Heretofore the manufacture of such devices has been a labor-intensive process.

More specifically, to fabricate an air turning assembly it is conventional practice to provide a pair of vane rails in accordance, for instance, with U.S. Pat. No. 2,861,597. The rails comprise flat sheet metal blanks having pairs of raised protuberances regularly spaced along the length thereof, the protuberances being slotted to receive the edge portions of vanes.

The manufacturing procedure involves placing an edge of a vane in the paired protuberances and securing the vane to the rail by distorting the edge portion of the vane projecting through the slots of the protuberances After the first vane is thus affixed the worker must repeat the process serially, mounting vanes in each of the paired protuberances of the first rail. Thereafter the rail carrying the first edges of the series of vanes is placed downmost and the second rail applied over the free edges of the vanes one by one, inserting the free edges into the protuberances and distorting the projecting edge portions as set forth above to lock the free edges of the vanes to the second rail.

The operation of manually mounting the vanes in the rails, inserting the partially fixed vanes, serially applying the free edges of the vanes to the second rail, etc. is time-consuming and frequently, in handling, one or more of the vanes will become dislodged from the first rail, requiring reinsertion and re-affixation.

In our above referenced patent and application there is disclosed an automatic mechanized air turning assembly forming apparatus, wherein lengths or rolls of vane rail material are automatically advanced and air directing vanes automatically staked into position between the rails.

SUMMARY OF THE INVENTION

The present invention may be summarized as directed to a portable apparatus for simplifying the fabrication of air turning assemblies. In accordance with the invention the apparatus includes upper and lower parallel tracks for holding lengths of vane rail. The tracks are springingly mounted so as to biased toward each other. Air turning vanes are sequentially mounted and staked to the rails by first inserting an edge of the vane into supporting slots, known per se, in one rail and thereafter snapping the opposite edge of the vane into complemental slots formed in the opposite rail. The vane is temporarily captured between the two rails as a result of the spring action whereby the rails are biased toward each other.

The device includes a series of staking chisels disposed beneath the lower track and normally spaced from the rail as a result of the spring support. A crimping or staking head is movably mounted above the upper rail. The staking head includes a chiseled tooth or teeth adapted to be aligned with portions of the vanes extending through the upper vane rail. With the parts thus assembled, the chiseled teeth of the staking head are shifted downwardly and function simultaneously to stake the upper edge of the vane locking it securely to the upper rail and also to bodily shift the upper and lower rails downwardly against the bias of the springs, whereby the stationary chisel teeth below the lower rail stake the lower edges of the vane locking the lower edges within the slots in the lower rail. The process is repeated until the total number of vanes has been affixed between the rails whereafter the completed turning assembly is removed from the device.

Preferably, the rails are provided with sprocket openings which are coordinated with the vane retaining slots enabling the rails to be located relative to the fixed chisels. Similarly, the sprockets are employed to locate the staking head relative to the upper rail. The staking head is slideably mounted on a carriage to permit its successive alignment with vanes to be secured, the carriage preferably being pivotedly mounted to the frame to permit the formed air turning device to be readily removed.

It is accordingly an object of the invention to provide an apparatus for facilitating the formation of air turning assemblies.

A further object of the invention is the provision of a device of the type described which is relatively portable, permitting on site assembly of air turning units.

A still further object of the invention is the provision of a device of the type described which may be readily adjusted for handling air turning assemblies of various widths.

A still further object of the invention is the provision of a device of the type described which facilitates locating the vanes either centrally relative to the rails, or in an offset relation thereto in accordance with the air turning function to be served.

DETAILED DESCRIPTION OF DRAWINGS

Figures 1, 2, 2A, 2B:
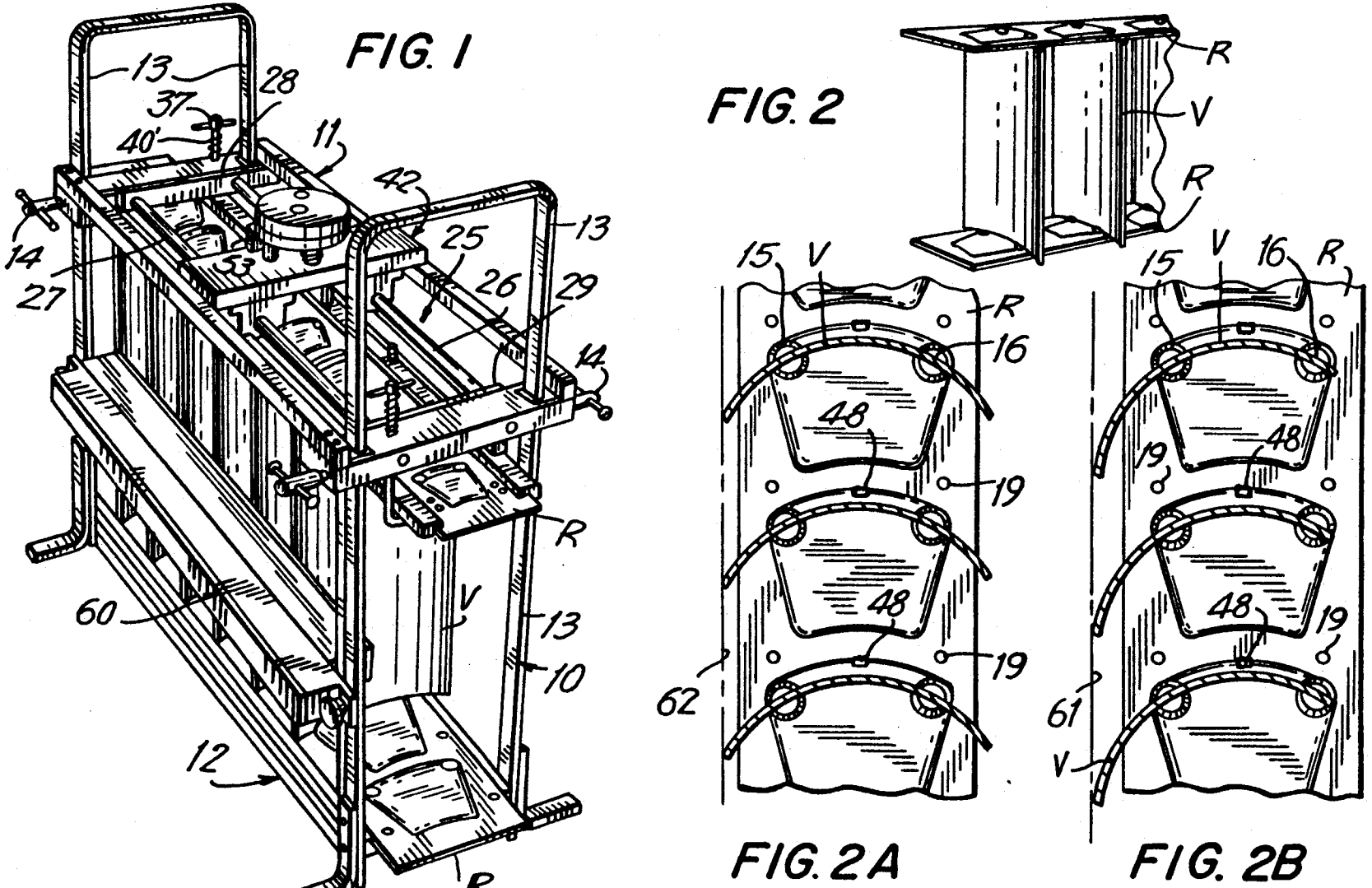
FIG. 1 is perspective view of an apparatus in accordance with the invention.
FIG. 2 is a perspective view of a typical air turning assembly.
FIGS. 2*a* and 2*b* are fragmentary plan views of sections of air turning assemblies illustrating the possible alternate disposition of the vane components relative to the vane rails utilizing the device of the instant invention.
Figure 3:
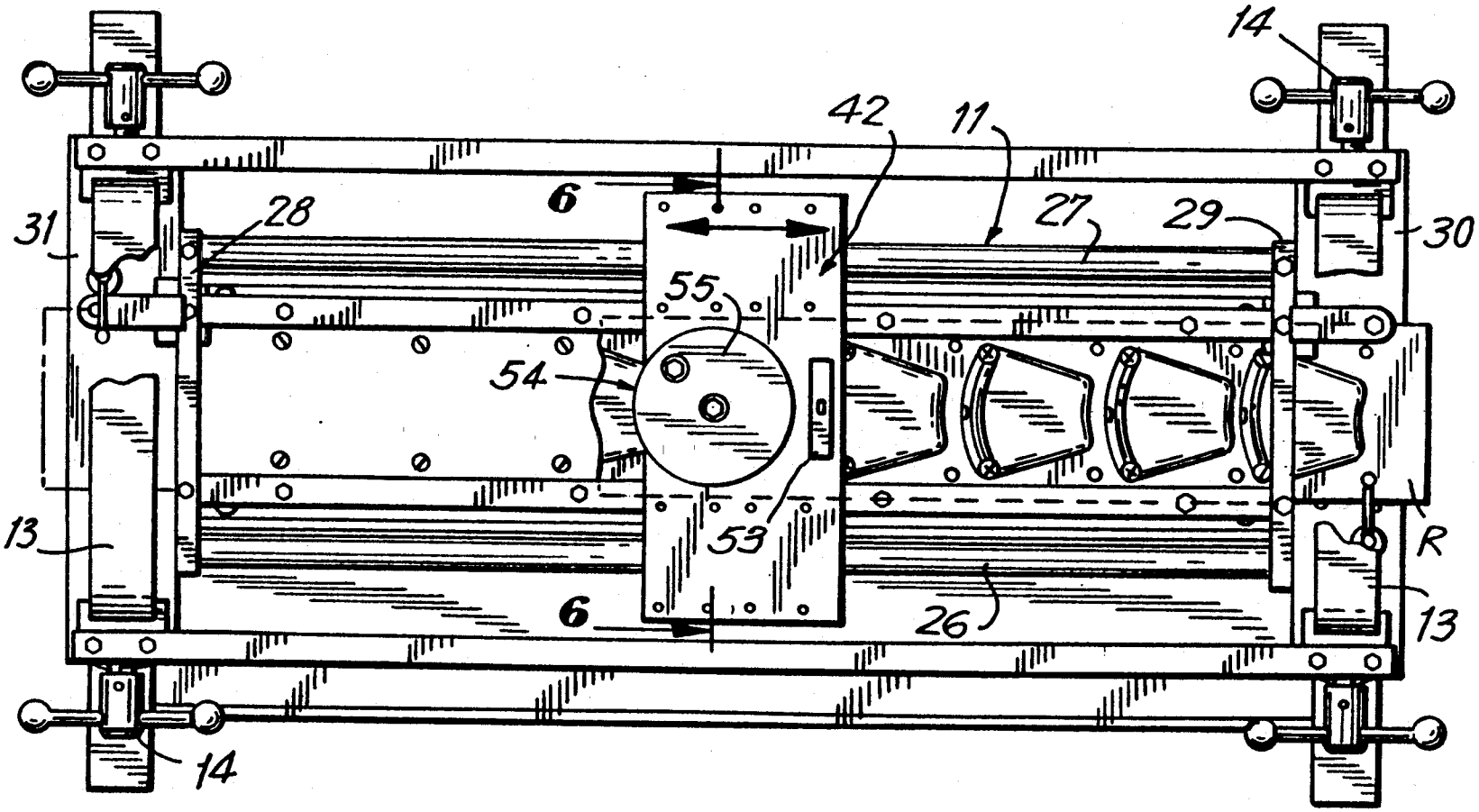
FIG. 3 is a top plan view of the apparatus of the invention with portions of the vane rail broken away to expose elements of the lower track.
Figure 4:
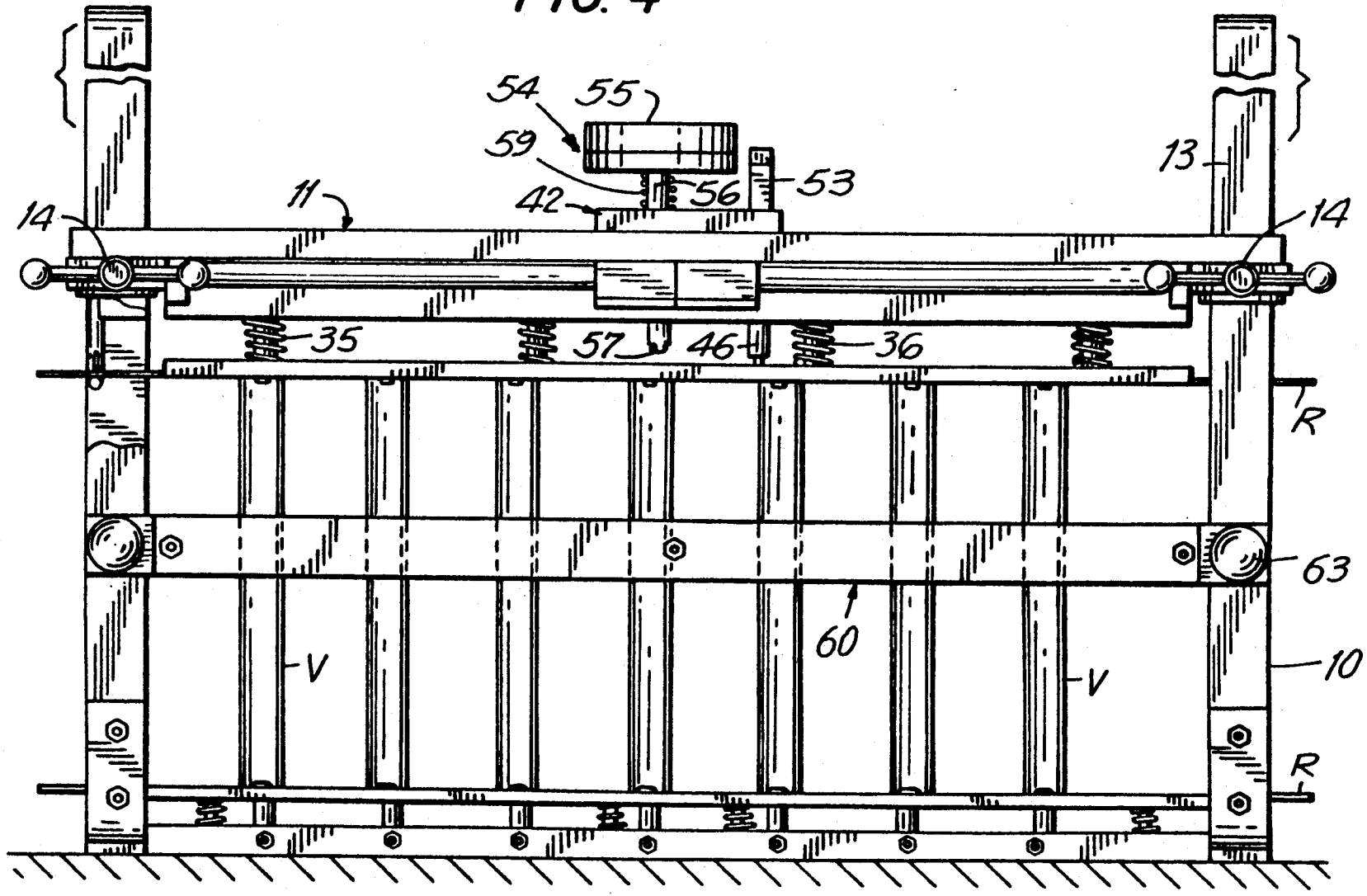
FIG. 4 is a side elevational view of the apparatus.

In FIG. 1 the device is shown in perspective, including as its principal parts a frame 10, an upper assembly 11 and a lower track assembly 12. The upper track assembly 11 is adjustably mounted on vertical bars 13 and retained in the adjusted position by clamps 14. Adjustment of the upper assembly 11 enables the apparatus to process vane components V of variable heights.

For convenience, there is shown in FIG. 2 an air turning assembly in perspective, the assembly being known per se and being comprised of a spaced pair of vane rails R spanned by a series of vanes V. As is conventional, the rails include depressions 15, having slots 16 formed thereacross. The edge portions of the vanes V are disposed within the slots and the vanes are locked to the slots by distortion of the elements of the vanes extending through the slots. As is conventional, the vanes V may be symmetrically located relative to the rails (FIG. 2*a*) or may be laterally offset as shown in FIG. 2*b*.

As conducive to an understanding of the invention, the operation of forming an air turning assembly using the apparatus of the invention comprises supporting upper and lower vane holding rails R in a parallel spaced relation in a manner that the rails are yieldably urged toward each other. Vanes V are temporarily mounted in the retaining slots 16 of opposed rails by first introducing an edge portion of the vane into the slots of the lower rail while the vane is canted relative to the rails.

Thereafter, the unmounted edge of the vane is slid along the length of the rails until it is aligned with the slots in the rail opposed to those mounted in the opposite rail, such movement of the vane longitudinally of the rails functioning to cam the rails apart against the biasing force noted, until the edge snaps into the slots of the upper rail. With the vane thus temporarily supported, a staking apparatus is aligned with the edges of the vane projecting through slots 16. The staking apparatus includes upper chisel teeth, a stationary pair of chisel teeth being disposed in registry with the edge portions of the vane projecting through the rail held in the lower track or guideway. When a downward force is exerted on the staking assembly (by a hammer or by an air cylinder), the rail components beneath the staking device and the temporarily mounted vane are bodily shifted downwardly whereby the stationary chisels deform the portions of the vane projecting through the protuberances 15 of the lower rail, while the chisel teeth in the movable staking assembly deform the projecting vane portions extending through the protuberances of the upper rail. This sequence (mount vane, align staking device, depress upper chisel) is repeated until a completed air turning assembly is formed.

Turning again to the drawings, the lower rail retaining track assembly 12 (see FIG. 6) is comprised of a spaced parallel pair of carrier bars 17 extending the length of the machine, the bars being recessed at 18 for the reception of the lower rail R therebetween. The rail R is locked to the lower tracks 17 as by a spring detent (not shown) which engages within sprocket apertures 19 formed in the rails R in coordinated location relative to protuberances 15.

Figure 6:
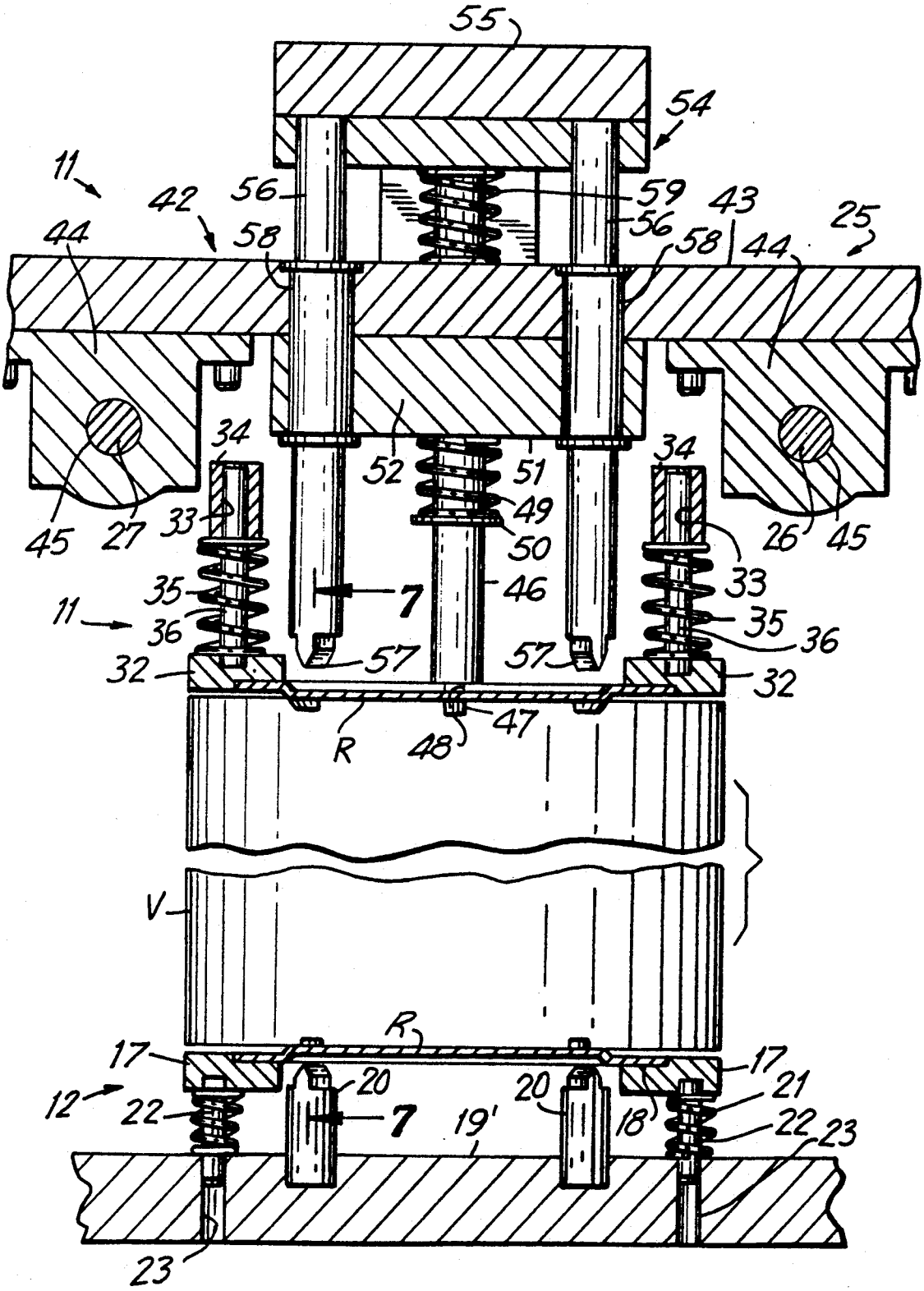
FIG. 6 is a magnified vertical, sectional view taken on the line 6—6 of FIG. 6.

In base plate 19′ of the device there are mounted a series of fixed chisel members 20, pairs of said chisel members being spaced longitudinally along the length of the base plate to register with protuberances of the rail R when the rail is clamped by its sprockets to the tracks 17. The tracks 17 are spaced from the base plate 19 by interposed springs 21. Guide rods 22 depend from the tracks 17 and are moveably mounted within bores 23 of the base plate, whereby the tracks 17 may be shifted downwardly relative to the base plate 19′. As best seen in FIG. 6 the springs 21 normally support lower rail R at a height slightly above the chisels 20.

The upper assembly 11 comprises a pivotable frame 25 formed of parallel guide bars 26,27 the ends of which are connected by end struts 28,29. The distal ends of guide bar 27 pass through bearing apertures in struts 28,29 and are fixedly mounted in end frames 30,31 of the upper assembly, whereby the frame 25 is pivotable about a horizontal axis coincident with guide rod 27.

An upper track assembly is formed by spaced tracks 32 similar to tracks 17, the tracks being upwardly moveably mounted relative to bores 33 formed in castings 34 forming portions of the frame 25. Spring 35 bias tracks 32 downwardly, the tracks being suspended from guide pins 36 the upper ends of which are slideably mounted within bores 33.

As will be apparent, springs 35 urge tracks 32 downwardly and springs 21 urge lower tracks 17 upwardly whereby a vane V the height of which slightly exceeds the distance between tracks 17 and 32 may be clampingly disposed between the said upper and lower tracks (also referred to as rail retainers).

Figure 5:
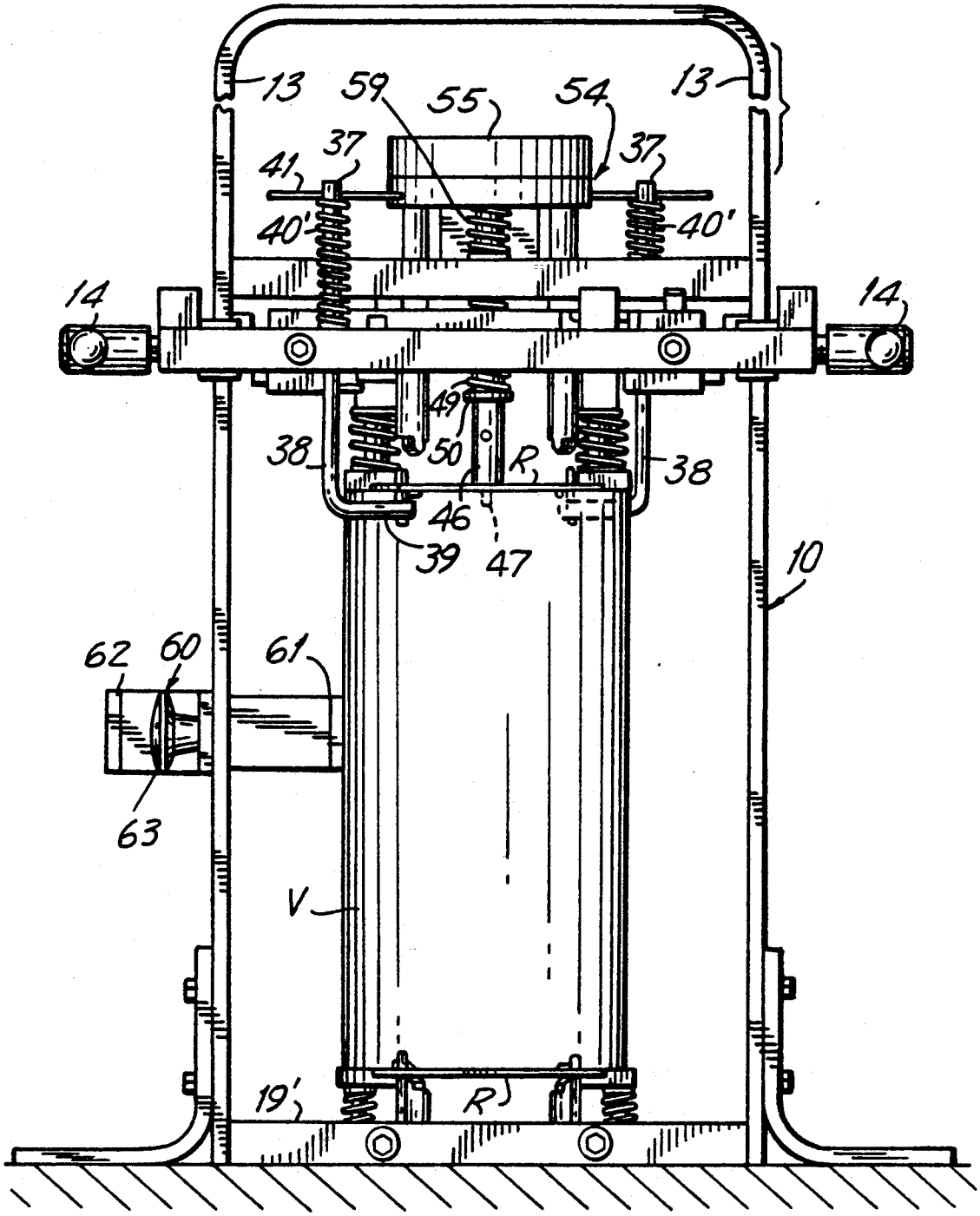
FIG. 5 is an end elevational view of the apparatus.

Rails R are held against upper track 32 by detents 37. As best seen in FIG. 5, the detents 37 comprise rods 38 extending slideably through the frame, the rods including hook portions 39 having upward projecting pins 40 which likewise are coordinated with sprocket apertures 19 formed in the rails. Spring members 40′ biased against lift handles 41 of the members 37 urge the rods 38 and hence locator pins 40 upwardly to support the upper rail against the upper track portions 32.

It will be seen that the detents 37 also are coordinated with sprockets 19 to align the protuberances 15 of the upper rail with the protuberances (and chisels 20) of the lower track assembly.

A staking carriage assembly 42 is longitudinally, slideably mounted on guide rods 27,26. The carriage assembly 42 includes a mounting platform 43 to the undersurface of which is mounted a pair of bearing blocks 44 having throughgoing bores 45 slideably embracing guide rods 26,27. The carriage 42 includes a locator plunger 46 vertically, moveably mounted to the carriage, the plunger including a locator pin 47 at its lowermost end.

As will be apparent from the succeeding discussion, the locator pin enters locator apertures 48 of the upper vane rail to coordinate the location of the assembly 42 relative to the protuberances of the rail.

The plunger 46 is normally biased downwardly by spring 49 interposed between collar 50 and undersurface 51 of reenforcing block 52. A handle 53 is secured to the upper end of plunger 46 to enable release of locator pin 47 from locator slot 48.

Platform 42 carries a staking assembly 54 comprised of a staking head 55 from which depends a pair of chisel members 56 provided with chisel teeth 57 at the lowermost ends thereof. Chisel members 56 are slideably guided in bores 58, the chisels being normally maintained in the raised position shown in FIG. 6 by spring 59 interposed between platform 42 and the undersurface of the member 55.

As seen in FIGS. 2*a* and 2*b*, the vanes V may be symmetrically located (FIG. 2*a*) or offset (FIG. 2*b*) relative to the rails. In order to accommodate the varying conditions there is provided (see FIG. 5) a locator bar assembly 60 clampingly engagable with a pair of legs 13 of the frame. Locator bar 60 includes stop surfaces 61,62 which may be selectively mounted as by threaded knobs 63, such that either of the surfaces 61 or 62 extend inwardly between the legs 13.

As will be apparent from FIG. 5 where the stop surface 61 is innermost, the edge portion of blades arrayed against the stop surface 61 will be displaced further from the center line of the device than would be the case if the stop surface 62 were arrayed innermost. When the stop surface 61 is innermost, the blades will be arrayed as shown in FIG. 2*b*, whereas when stop surface 62 is innermost the blades will be symmetrically aligned as shown in FIG. 2*a*.

The operation of the device will be evident from the preceding description. A preliminary heightwise adjustment of the upper assembly is effected in accordance with the length of the vanes V to be employed. Lower rail R is mounted in the lower tracks 17 and locked into position by lower track detents entering sprockets 19.

In similar fashion, an upper rail member is connected to the upper track 32 and locked into position through the use of detents 37. The pivotal frame 25 is locked in its downwardly pivoted condition as by dog levers (not shown) at the opposed ends of the frame, which are pivoted to overlie end struts 28 and 29. With the parts thus positioned (the protuberances of the upper and lower rails being aligned, due to their coordination with the locator sprockets) a first vane is mounted between the rails. Mounting is effected by inserting a first end of the vane in the slots of one of the rails with the vane in canted position, and thereafter shifting the vane laterally to cam the rails apart, as permitted by compression of springs 21 and 35 until the opposite end of the vane is aligned with the slots of the other rail, whereupon the rails will snap together capturing the theretofore free end of the vane between the slots of the opposed rails. In normal operation, it is preferable to mount the lower edge of the vane and slide the upper edge laterally, although it is feasible to mount the upper edge of the vane in the top rail and laterally slide the lower edge of the vane thereafter.

The operation of seating a vane between the opposed rails is materially facilitated through the use of rail structures in accordance with the above referenced pending application and patent, wherein the trailing edge of the vane retaining slots is deflected further from the plane of the rail than the leading edge and the protuberances are formed in a cammed configuration, whereby sliding of the unmounted edge of the vane over the protuberances first cams the rails apart and the trailing edge functions as a stop surface.

Figure 7:
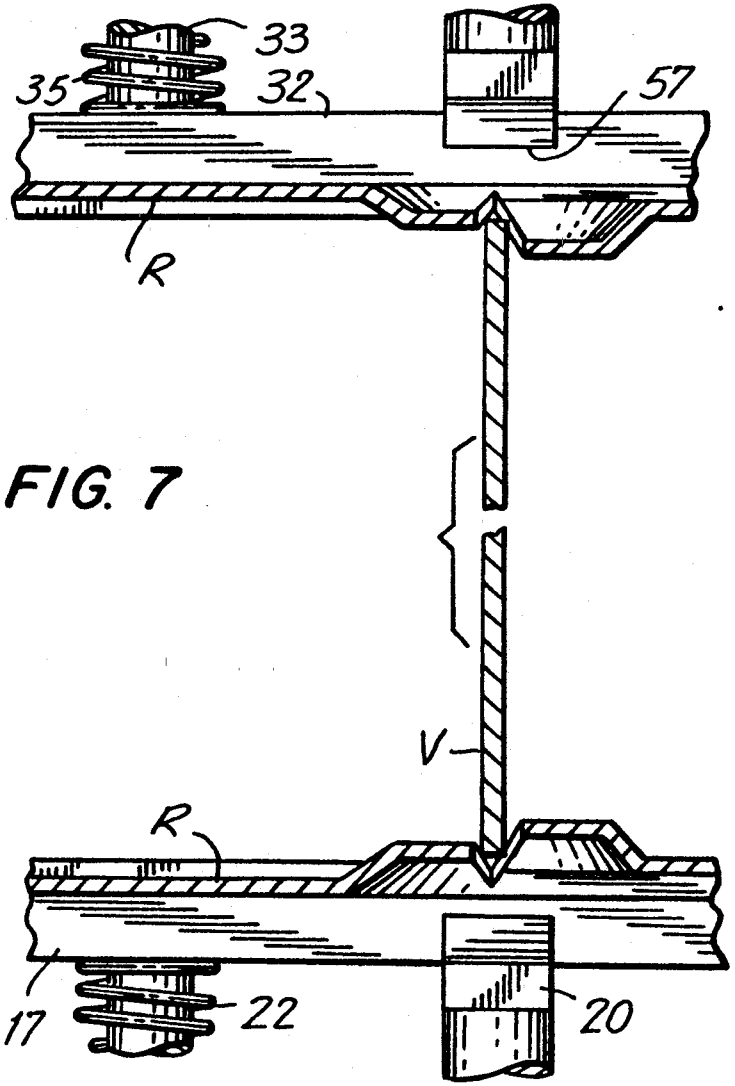
FIG. 7 is a fragmentary vertical, sectional view taken on the line 7—7 of FIG. 6, i.e. prior to staking of a vane.

With a vane mounted temporarily between the opposed rails, the staking assembly 42 is slid into registry with the vane, alignment being effected by the tooth 47 of plunger 46 entering into locator slot 48 of the upper rail. This condition of the components is illustrated in FIG. 6 of the drawings. Thereafter, the platen or head 55 of the staking assembly is forced downwardly to the position of FIG. 8, the requisite force being effected either by a hammer blow or an air cylinder. Downward movement of the chisel assembly results in deformation of the four portions of the vane projecting through the protuberances 15 of the rails. In FIG. 7 the vane V is shown in its temporarily mounted position, i.e. before the chisels are activated.

Figure 9:
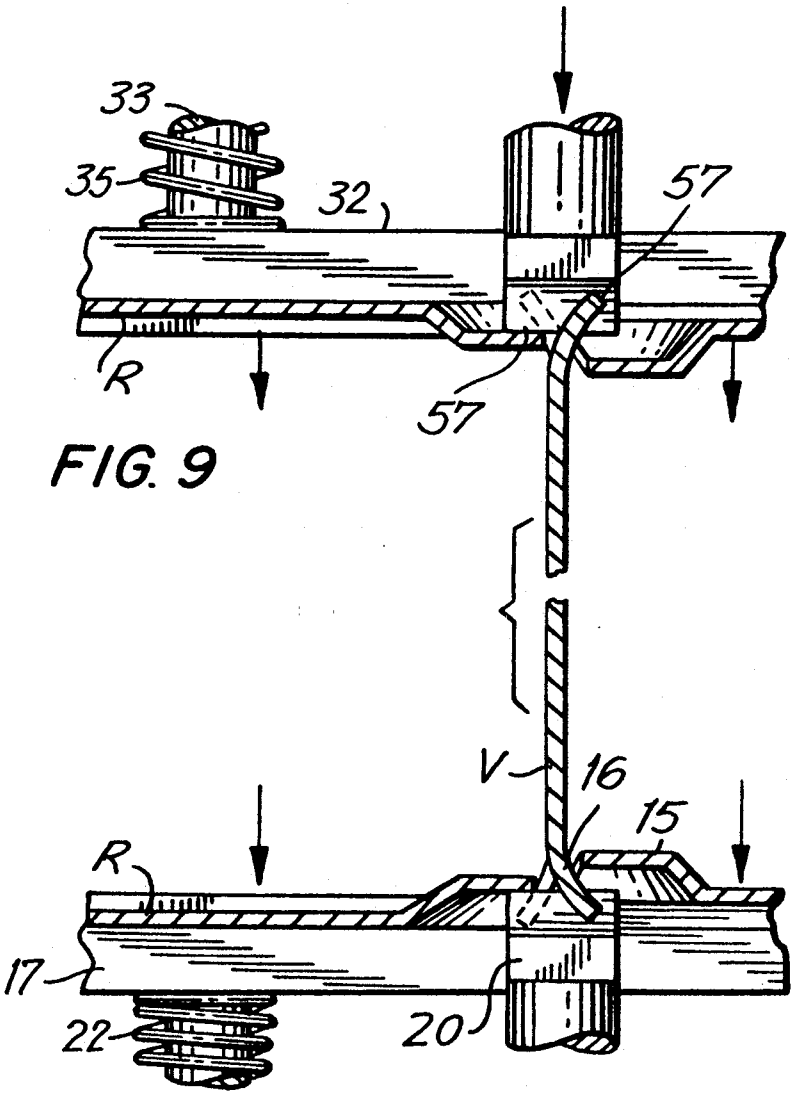
FIG. 9 is a sectional view similar to FIG. 7 taken on the line 9—9 of FIG. 8 after staking of the vane.
Figure 8:
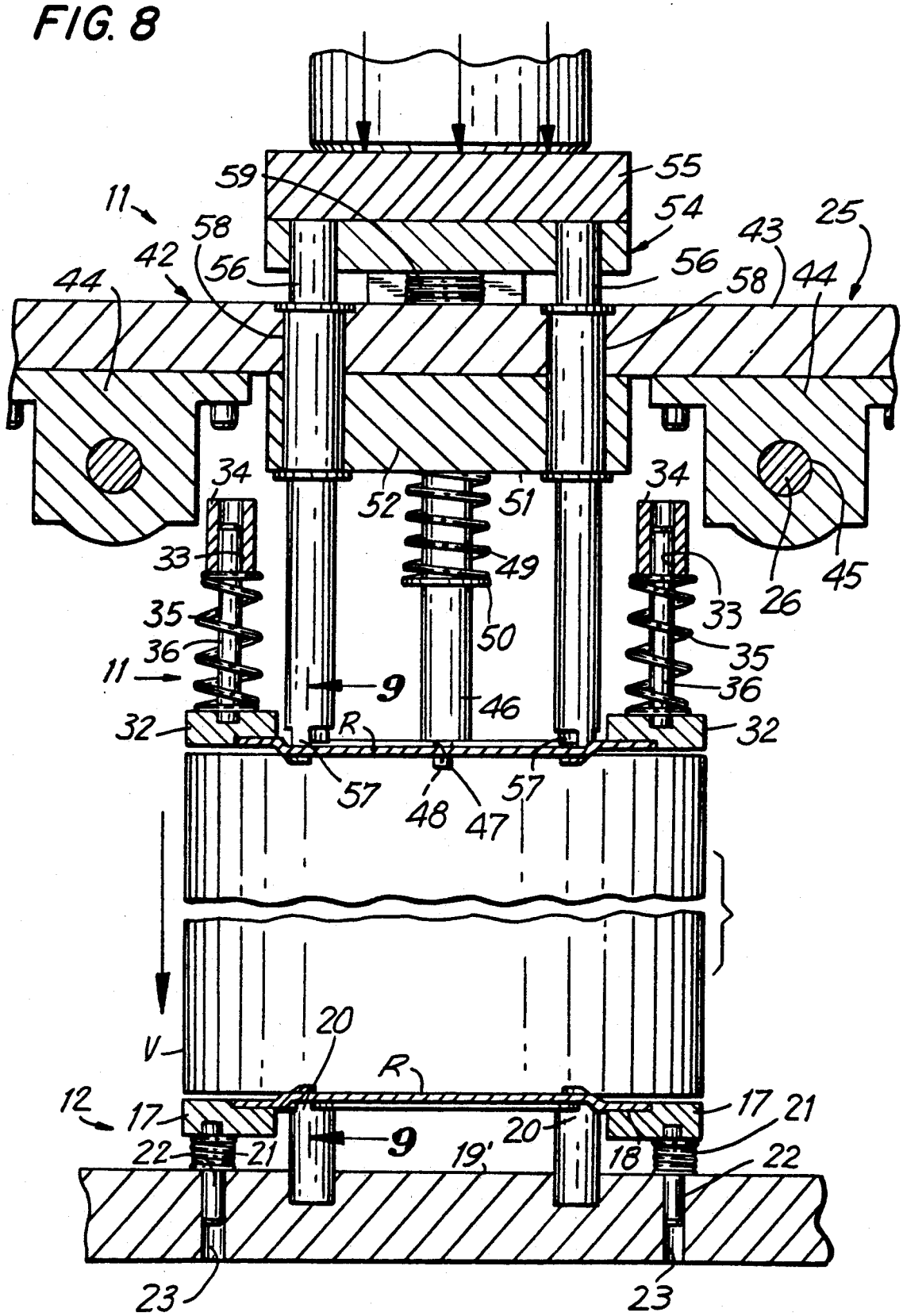
FIG. 8 is a sectional view similar to FIG. 6, showing the position of the parts after a vane has been staked into engagement with the vane rail components.

Comparing FIG. 7 to FIG. 9 it will be seen that the downward movement of the chisel assembly has forced the lower rail mounted on tracks 17 downwardly, whereby the lower chisels 20 enter protuberances 15 in the lower track and split and deflect the lower edge of the vane as shown in FIG. 9 locking the lower edge in the slot 16 of the protuberance. Simultaneously, as is apparent from FIG. 9, the chisels 57 have split the upper edge of vane V within upper protuberance 15, whereby the vane is securely connected to the respective lower and upper rails.

The described operation is successively carried out as each additional vane is installed in the manner described, i.e. the vane is positioned, the staking assembly shifted into registry with the temporarily mounted blade, and the blade permanently mounted by activation of the chisels of the staking assembly.

After the final vane has been affixed in the manner described the frame assembly 25 is pivoted upwardly, the detents, e.g. 37, released, whereupon the completed air turning assembly may be slid laterally from the machine.

The apparatus is relatively lightweight enabling the worker to bring the unit to the job site. Completed air turning units may be fabricated by a skilled operator in two minutes or less, an operation which if manually carried out would take upwards of ten minutes. The device is readily adjustable to accommodate vanes of a variety of widths, and in addition enables accurate symmetrical or offset alignment of the blade edges.

As will be apparent to those skilled in the art and familiarized with the instant disclosure, numerous variations in details of construction may be made without departing from the spirit of the invention. Accordingly, the invention should be broadly construed within the scope of the appended claims.

Having thus described the invention and illustrated its use, what is claimed as new and is desired to be secured by Letters Patent is:

1. Apparatus for forming an air turning device, said device being comprised of a spaced pair of vane rails having longitudinally spaced vane receiving slots formed therein and vanes clampingly received in said slots, said apparatus comprising a frame, a lower track means on said frame for receiving a first said vane rail, an upper track means on said frame in parallel spaced relation to said lower track means for receiving a second said vane rail, a plurality of fixed, longitudinally spaced chisel members mounted on said frame beneath said lower track, spring means engaging said lower track means for yieldingly supporting said lower track means above said chisel members, a carriage slideably mounted to said frame above said upper track means for movement longitudinally along said frame in proximate spaced relation to said upper track means, and upper chisel means slideably mounted in said carriage for movement in a direction toward and away from said lower chisel members whereby said upper chisel means, upon movement toward said lower chisel members, bodily engages and shifts a vane in registry with said chisel means and said lower track toward said lower chisel members thereby to simultaneously deform the upper and lower edges of said vane by contact with said chisel means and chisel members, respectively.

2. Apparatus in accordance with claim 1 and including locator means on said carriage adapted to engage a vane rail mounted in said upper track means for releasably locking said carriage to said rail at a predetermined longitudinal location along said upper track means.

3. Apparatus in accordance with claim 1 and including locator means on said upper and lower track means adapted to engage vane rails mounted in said track means and lock said rails in predetermined mutually aligned positions relative to said tracks.

4. Apparatus in accordance with claim 1 and including adjustment means interposed between said frame and said upper track means for variably spacing said upper and said lower track means.

5. Apparatus in accordance with claim 1 and including a side bar means for engaging and aligning the edges of the vanes disposed between said rails, said bar means being mounted to said frame intermediate and in parallel spaced relation to said track means, said side bar means having a stop edge in lateral, outwardly offset relation to a vertical plane tangent to a side margin of said upper and lower tracks.

6. Apparatus in accordance with claim 5 wherein said side bar means is mounted for horizontal adjusting movement toward and away from said plane, thereby varying the lateral position of said blades relative to said rails.

7. Apparatus in accordance with claim 1 and including spring means yieldably urging said upper track means toward said lower track means.

8. Apparatus in accordance with claim 1 wherein said carriage and upper track means are mounted to said frame for pivotal movement about a horizontal pivot axis.

9. An air turning assembly fabricating tool comprising upper and lower spaced parallel rail retainer means for holding, respectively( upper and lower vane retainer rails in spaced parallel relation, spring means yieldingly biasing said retainer means toward each other whereby an air turning vane may be temporarily supported between said rails by the force of said spring means, fixed vane edge deforming means disposed in proximate spaced relation beneath said lower retainer means, movable vane edge deforming means disposed above said upper retainer means and in registry with said fixed deforming means, said movable deforming means being shiftable between an upper limit position spaced above said upper retainer means and a lower limit position, said upper deforming means, upon shifting from said upper to said lower limit position being effective to engage and distort upper edge portions of a said vane disposed between said rails and aligned with said deforming means and to bodily depress said upper and lower retainer means and vane to engage lower edge portions of said vane against said fixed deforming means.

10. Apparatus in accordance with claim 9 and including a plurality of said fixed deforming means in longitudinally, mutually spaced relation beneath said lower retainer means, and means for shifting said movable deforming means sequentially into registry with said fixed deforming means.

11. Apparatus in accordance with claim 10 and including alignment means operatively connected to said movable deforming means for coaction with said rail mounted in said upper retainer means to position said movable deforming means in said sequential registered positions.

* * * * *